US006530350B2

(12) United States Patent
Chiappini et al.

(10) Patent No.: US 6,530,350 B2
(45) Date of Patent: Mar. 11, 2003

(54) INTERNAL-COMBUSTION ENGINE WITH HYDRAULIC SYSTEM FOR VARIABLE OPERATION OF THE VALVES AND MEANS FOR COMPENSATING VARIATIONS IN VOLUME OF THE HYDRAULIC FLUID

(75) Inventors: Stefano Chiappini, Orbassano (IT); Andrea Pecori, Orbassano (IT); Francesco Vattaneo, Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 10/102,727

(22) Filed: Mar. 22, 2002

(65) Prior Publication Data

US 2002/0134328 A1 Sep. 26, 2002

(30) Foreign Application Priority Data

Mar. 23, 2001 (IT) ..... TO21A0269

(51) Int. Cl.[7] ..... F01L 9/02; F01L 13/00

(52) U.S. Cl. ..... 123/90.12; 123/90.16; 123/90.19; 123/90.49; 123/198 F

(58) Field of Search ..... 123/90.12, 90.13, 123/90.15, 90.16, 90.19, 90.48, 90.49, 198 F

(56) References Cited

U.S. PATENT DOCUMENTS

| | | | | | |
|---|---|---|---|---|---|
| 5,127,375 | A | * | 7/1992 | Bowman et al. | 123/90.12 |
| 5,263,441 | A | * | 11/1993 | Rembold et al. | 123/90.12 |
| 6,112,710 | A | * | 9/2000 | Egan, III et al. | 123/90.12 |
| 6,138,621 | A | * | 10/2000 | Albanello et al. | 123/90.12 |
| 6,192,841 | B1 | * | 2/2001 | Vorih et al. | 123/90.12 |
| 6,227,154 | B1 | * | 5/2001 | Wakeman | 123/90.16 |
| 6,321,701 | B1 | * | 11/2001 | Vorih et al. | 123/90.12 |
| 6,325,028 | B1 | * | 12/2001 | Albanello et al. | 123/90.12 |
| 6,412,457 | B1 | * | 7/2002 | Vorih et al. | 123/90.12 |
| 6,415,752 | B1 | * | 7/2002 | Janak | 123/90.12 |

* cited by examiner

*Primary Examiner*—Weilun Lo

(57) ABSTRACT

In an internal-combustion engine with a hydraulic system for variable operation of the engine valves, there is envisaged at least one supplementary reservoir bled off to the atmosphere, communicating with the low-pressure circuit for compensating for the variations in volume of the hydraulic fluid that derive from the variations in temperature and for thus preventing air bubbles from forming in the circuit.

4 Claims, 2 Drawing Sheets

INTERNAL-COMBUSTION ENGINE WITH HYDRAULIC SYSTEM FOR VARIABLE OPERATION OF THE VALVES AND MEANS FOR COMPENSATING VARIATIONS IN VOLUME OF THE HYDRAULIC FLUID

BACKGROUND OF THE INVENTION

The present invention relates to internal-combustion engines of the type comprising:

at least one induction valve and at least one exhaust valve for each cylinder, each valve being provided with respective elastic means that bring back the valve into the closed position to control communication between the respective induction and exhaust ducts and the combustion chamber;

a camshaft for operating the induction and exhaust valves of the cylinders of the engine by means of respective tappets, each induction valve and each exhaust valve being actuated by a cam of said camshaft;

in which at least one of said tappets controls the respective induction or exhaust valve against the action of said elastic return means via the interposition of hydraulic means including a hydraulic chamber containing fluid under pressure;

said hydraulic chamber containing fluid under pressure being connectable, via a solenoid valve, to an outlet channel for decoupling the valve from the respective tappet and causing fast closing of the valve under the action of respective elastic return means;

said hydraulic means further comprising a piston associated to the stem of the valve and slidably mounted in a guide bushing, said piston being set facing a variable-volume chamber defined by the piston inside the guide bushing, said variable-volume chamber being in communication with the hydraulic chamber containing fluid under pressure by means of an end aperture of said guide bushing, said piston having an end appendage designed to be inserted into said end aperture during the final stretch of the closing stroke of the valve in order to restrict the communication port between said variable-volume chamber and said hydraulic chamber containing fluid under pressure, so as to slow down the stroke of the valve in the proximity of its closing, in which the aforesaid outlet channel communicates with an accumulator for fluid under pressure and with a feed pipe for feeding the fluid coming from a feed pump.

An engine of the type referred to above is, for example, described and illustrated in the European patent applications Nos. EP-A-0 803 642 and EP-A-1 091 097 filed by the present applicant.

Studies and tests carried out by the present applicant have shown that some problems may arise during operation, particularly when the engine stops running at low temperatures on account of the consequent variations in the volume of the hydraulic fluid (typically oil). When the engine has not been running for a long time in a low-temperature environment, the oil in the low-pressure circuit, i.e., in the section between oil feed and the solenoid valve, contracts and leaks, so freeing spaces in the circuit which generate air bubbles that are difficult to eliminate and subsequently impair operation of the system during engine starting.

SUMMARY OF THE INVENTION

The purpose of the present invention is to overcome the above-mentioned problem by providing a system which reduces as far as possible formation of air bubbles in the circuit following upon variations in the volume of the hydraulic fluid resulting from variations in the temperature of the fluid when the engine is turned off and from leakage of the hydraulic fluid through the gaps resulting from constructional play of the various components.

With a view to achieving this purpose, the subject of the invention is an engine having all the characteristics referred to at the beginning of the present description and moreover characterized in that connected to the aforesaid channel, upstream of the solenoid valve, is at least one supplementary fluid reservoir, bled off to the atmosphere, which is partially occupied by the fluid in the normal operating condition of the engine and which is emptied partially of fluid when the engine stops running at low temperatures, and which fills up, instead, in the event of expansion of the hydraulic fluid resulting from an increase in temperature.

In other words, the system is equipped with a sort of expansion box or expansion vessel which contains a certain amount of hydraulic fluid and which is consequently able to return this fluid to the circuit in the low-temperature condition so as to prevent formation of air bubbles in the circuit, and is able to receive the fluid back into it again when the temperature rises.

In one first embodiment, the aforesaid supplementary reservoir consists of a vessel distinct from the accumulator and has a bottom end connected to the circuit and a top end bled off to the atmosphere.

In another embodiment, the supplementary reservoir consists of the same vessel as the accumulator, which in this latter case has a piston with a restricted hole having a pre-determined diameter which enables the expanding fluid to occupy the volume of the accumulator above the piston by passing through said hole. Of course, this solution may be utilized either as an alternative or in addition to the one already mentioned above, which envisages a distinct supplementary reservoir.

According to the invention, it is also possible to contemplate the use, as supplementary reservoir, of the vessel of a pressurizer device that can be associated to the hydraulic circuit according to a technique known from the patent EP-B-0931912 held by the present applicant. This device is provided for the purpose of supplying a piston loaded by a spring with the oil under pressure that circulates in the circuit during operation of the engine, so as to be able to exploit the energy thus accumulated upon starting of the engine after the engine has not been running, in order to guarantee a prompt filling of the hydraulic circuit and a fast response of the system. In the case where such a device is provided, it is possible to envisage also for the latter an arrangement similar to the one described above with reference to the hydraulic accumulator, with an air bleeder to the atmosphere and a restricted hole of a pre-determined diameter in the piston of the device, which enables the expanding oil to flow through said hole into the cavity above the piston.

BRIEF DESCRIPTION OF THE DRAWINGS

Further characteristics and advantages of the present invention will emerge from the ensuing description, with reference to the attached drawings, which are provided purely by way of non-limiting examples, and in which.

DETAILED DESCRIPTION OF THE INVENTION

Figure 1:
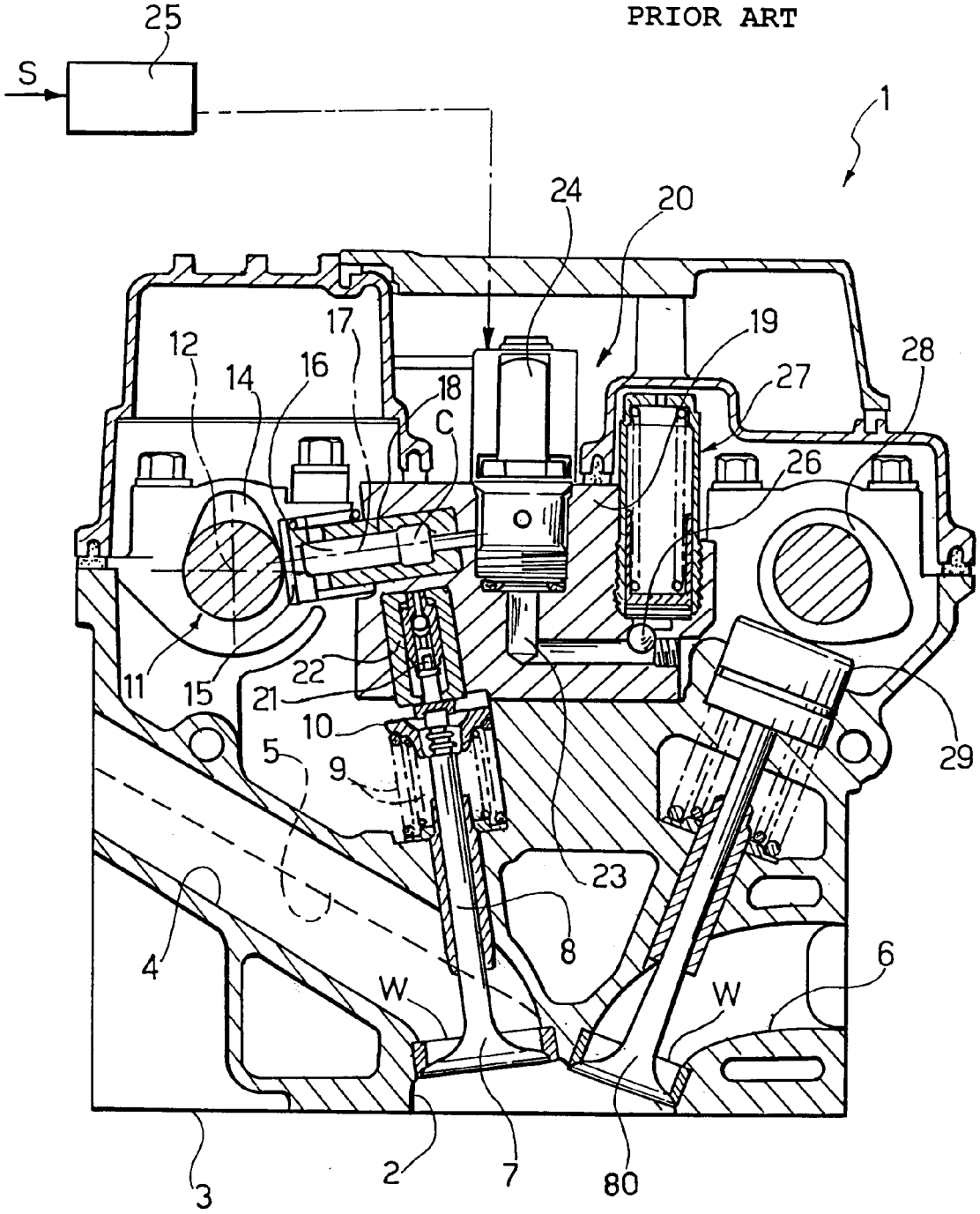
FIG. 1 PRIOR ART
FIG. 1 is a cross-sectional view of the cylinder head of an internal-combustion engine according to the embodiment known from the European patent application EP-A-0 803 642 filed by the present applicant.

With reference to FIG. 1, the internal-combustion engine described in the prior European patent application No. EP-A-0 803 642, as well as in EP-A-1 091 097, filed by the present applicant is a multi-cylinder engine, for example, an engine with five cylinders set in line, comprising a cylindrical head 1.

The head 1 comprises, for each cylinder, a cavity 2 formed in the base surface 3 of the head 1, the said cavity 2 defining the combustion chamber into which two induction ducts 4, 5 and two exhaust ducts 6 give out. Communication of the two induction ducts 4, 5 with the combustion chamber 2 is controlled by two induction valves 7 of the traditional poppet or mushroom type, each comprising a stem 8 slidably mounted in the body of the head 1. Each valve 7 is brought back to the closing position by springs 9 set between an inner surface of the head 1 and an end cup 10 of the valve. opening of the induction valves 7 is controlled, in the way that will be described in what follows, by a camshaft 11 which is slidably mounted about an axis 12 within supports of the head 1 and which comprises a plurality of cams 14 for operating the valves.

Each cam 14 for operating an induction valve 7 co-operates with the cap 15 of a tappet 16 slidably mounted along an axis 17, which in the case illustrated is directed substantially at 90° with respect to the axis of the valve 7 (the tappet may also be mounted so that it is aligned, as will be illustrated with reference to FIG. 3), within a bushing 18 carried by a body 19 of a pre-assembled subassembly 20 that incorporates all the electrical and hydraulic devices associated to operation of the induction valves, according to what is illustrated in detail in what follows. The tappet 16 is able to transmit a thrust to the stem 8 of the valve 7 so as to cause opening of the latter against the action of the elastic means 9 via fluid under pressure (typically oil coming from the engine-lubrication circuit) present in a chamber C and a piston 21 slidably mounted in a cylindrical body constituted by a bushing 22, which is also carried by the body 19 of the subassembly 20. Again according to the known solution illustrated in FIG. 1, the chamber C containing fluid under pressure associated to each induction valve 7 can be set in communication with an outlet channel 23 via a solenoid valve 24. The solenoid valve 24, which may be of any known type suitable for the function illustrated herein, is controlled by electronic control means, designated as a whole by 25, according to the signals S indicating operating parameters of the engine, such as the position of the accelerator and the engine r.p.m. When the solenoid valve 24 is opened, the chamber C enters into communication with the channel 23, so that the fluid under pressure present in the chamber C flows into said channel, and a decoupling of the tappet 16 of the respective induction valve 7 is obtained, the said induction valve 7 then returning rapidly into its closed position under the action of the return spring 9. By controlling the communication between the chamber C and the outlet channel 23, it is therefore possible to vary the opening time and opening stroke of each induction valve 7 as desired.

The outlet channels 23 of the various solenoid valves 24 all open out into one and the same longitudinal channel 26, which communicates with one or more pressure accumulators 27, only one of which can be seen in FIG. 1. All the tappets 16 with the associated bushings 18, the pistons 21 with the associated bushings 22, and the solenoid valves 24 and the corresponding channels 23, 26 are carried and made in the aforesaid body 19 of the pre-assembled subassembly 20, to the advantage of speed and ease of assembly of the engine.

The exhaust valves 80 associated to each cylinder are controlled, in the embodiment illustrated in FIG. 1, in a traditional way by a camshaft 28 by means of respective tappets 29.

Figure 2:
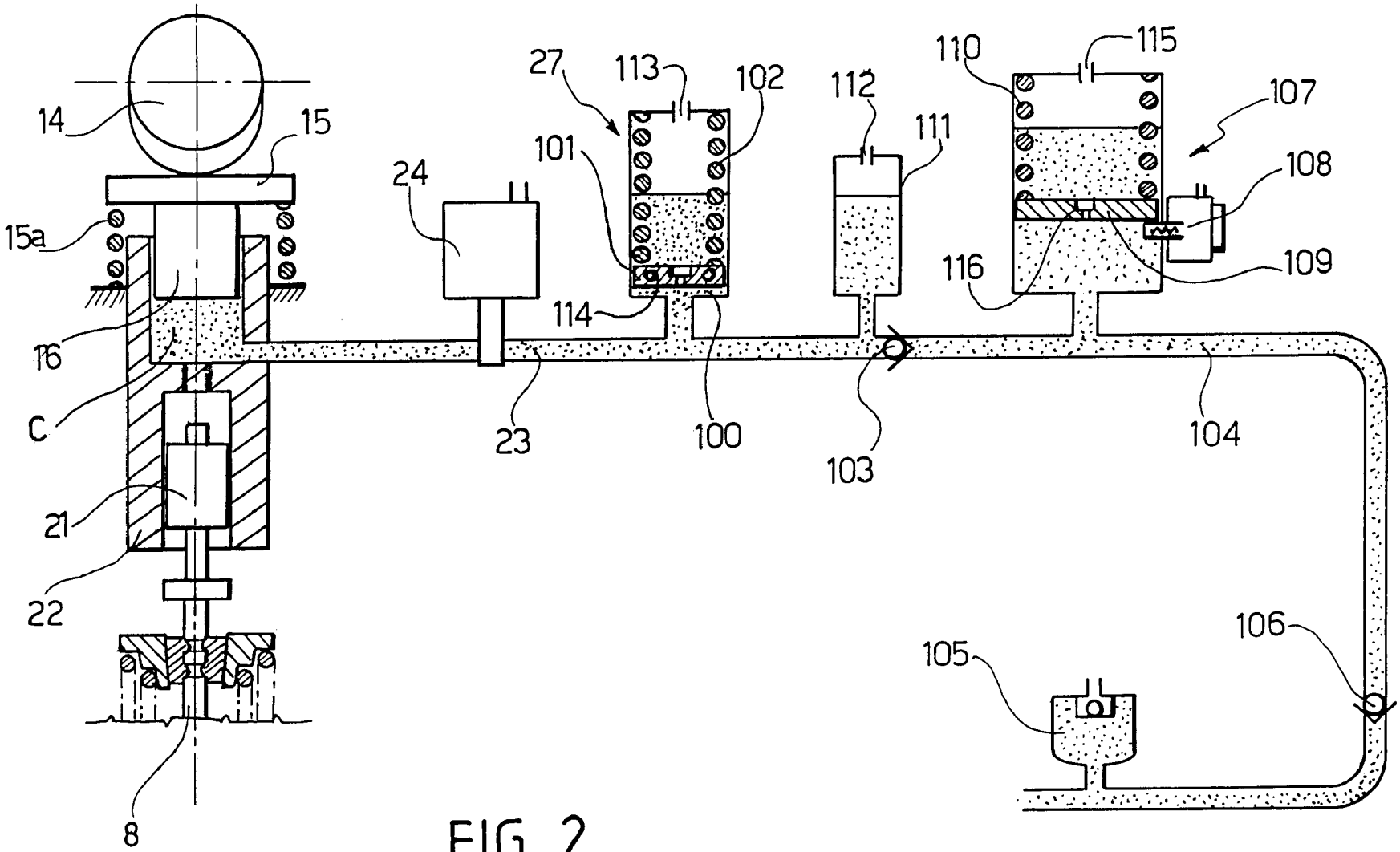
FIG. 2 is a diagram of the hydraulic system for variable operation of the valves, according to the present invention.

FIG. 2 illustrates, at an enlarged scale, the body 19 of the pre-assembled subassembly.

With reference to FIG. 2, the solenoid valve 24 controls communication of the pressure chamber C of the device for actuating the engine valve with the outlet channel 23. The latter communicates with the variable volume chamber 100 of the accumulator 27. When the solenoid valve 24 opens, the fluid present in the pressure chamber C flows into the outlet channel 23, and from here into the chamber 100 of the accumulator 27, so causing the piston 101 to rise under the action of the spring 102. The outlet channel 23 moreover communicates, via a non-return valve 103, with a channel 104 for feeding the oil under pressure coming from the engine oil-feed pump (not illustrated). In FIG. 2, the reference number 105 designates a valve for bleeding off any air bubbles that might possibly form in the initial stretch of the oil-feed pipe 104. A further non-return valve 106 is set downstream of the valve 105. According to a technique in itself known, also connected to the channel 104 is a pressurizer device 107 having a conformation substantially similar to that of a hydraulic accumulator, but also provided with a mechanical hooking device 108 (represented schematically) which keeps the piston 109 of said device in any position reached following upon its being raised owing to the pressure of the fluid. The device 108 withholds the piston 109 in position against the action of a spring 110. In accordance with what is envisaged in a prior European patent EP-B-0931912 held by the present applicant, when the engine is started, the mechanical hooking device 108 is released (for example, by means of a solenoid) in such a way that the spring 110 pushes the piston 109 suddenly downwards, so causing immediate feed of the amount of fluid contained in the device 107 in the direction of the pressure chamber C. This known device guarantees prompt response of the system after engine starting.

According to one first embodiment of the invention, connected to the channel 104 is a supplementary reservoir 111 having a bleeder 112 for bleeding off air to the atmosphere. The reservoir 111 functions as an expansion box or expansion vessel for the hydraulic circuit. The said reservoir is partially full of fluid during normal operation of the engine in such a way that it is able to return this fluid to the channel 104, in the event of contraction of the oil resulting from leakages and from the low temperature after the engine has stopped running, so as to prevent the formation of air bubbles. On the other hand, when the ambient temperature rises while the engine is not running, the oil can expand inside the reservoir 111. Of course, the operation described above is guaranteed by the presence of the air bleeder 112.

As an alternative or in addition to the solution described above, it is possible to exploit also the accumulator 27 as supplementary reservoir. In this case, also the accumulator has a bleeder 113 for bleeding off air to the atmosphere, and the piston 100 has a restricted hole 114 (not indicated in the figure) of a pre-determined diameter. When the engine is not running, a possible expansion of the oil due to high temperature causes the oil to flow through the hole 114 into the chamber of the accumulator above the piston 110. On the other hand, when there is a drop in temperature, the fluid can flow downwards through the said hole. The hole is in any case restricted in order not to impair normal operation of the accumulator when the engine is running.

A similar solution may also be adopted in the pressurizer device 107, which can have a bleeder 115 for bleeding off air to the atmosphere and a restricted hole 116 made in its piston 109, in such a way that the chamber of the said device above the piston 109 can be used as an expansion vessel.

As emerges clearly from the foregoing description, the system according to the invention is able to overcome the problem of formation of air bubbles in the circuit by using extremely simple means, providing one or more expansion vessels for compensating the variations in volume of the fluid, the said expansion vessels thus preventing the formation of air bubbles.

The present applicant has also developed means for guaranteeing bleeding off of any air that may possibly be present in the high-pressure section of the circuit, in particular in the pressure chamber C, upon engine starting. These means form the subject of a co-pending patent application filed by the present applicant.

What is claimed is:

1. An internal-combustion engine comprising:

at least one induction valve and at least one exhaust valve for each cylinder, each valve being provided with respective elastic means that brings back the valve into the closed position to control communication between the respective induction and exhaust ducts and the combustion chamber;

a camshaft for operating the induction and exhaust valves of the cylinders of the engine by means of respective tappets, each induction valve and each exhaust valve being actuated by a cam of said camshaft, in which at least one of said tappets controls the respective induction or exhaust valve against the action of said elastic return means via the interposition of hydraulic means including a hydraulic chamber (C) containing fluid under pressure;

said hydraulic chamber containing fluid under pressure being connectable, via a solenoid valve, to an outlet channel for decoupling the valve from the respective tappet and causing fast closing of the valve against the action of respective elastic return means;

said hydraulic means further comprising a piston associated to the stem of the valve and slidably mounted in a guide bushing, said piston being set facing a variable-volume chamber defined by the piston and the guide bushing, said variable-volume chamber being in communication with the hydraulic chamber (C) containing fluid under pressure by means of a communication port constituted by an end aperture of said guide bushing, said piston having an end appendage designed to be inserted into said end aperture during a final stretch of a closing stroke of the valve in order to restrict the communication port between said variable-volume chamber and said hydraulic chamber containing fluid under pressure, so as to slow down the stroke of the valve in a proximity of its closing, in which the aforesaid outlet channel communicates with an accumulator for fluid under pressure and with a feed pipe for feeding the fluid coming from a feed pump, wherein connected to the aforesaid outlet channel, upstream of the solenoid valve, is at least one supplementary fluid reservoir, bled off to the atmosphere, which is partially filled with fluid in the normal operating condition of the engine, is at least partially emptied following upon contraction of the fluid in cold conditions, and fills most following upon expansion of the fluid in hot conditions, both when the engine stops and when it is running, as the case may be.

2. The engine according to claim 1, wherein the aforesaid supplementary reservoir consists of a vessel distinct from the pressure accumulator.

3. The engine according to claim 1, wherein also said pressure accumulator functions as a supplementary reservoir, said accumulator having a bleeder for bleeding air off to the atmosphere and a piston with a restricted hole having a pre-determined diameter, said hole enabling the hydraulic fluid to flow into the chamber of the accumulator above the piston.

4. The engine according to claim 1, including a pressurizer device comprising a piston, wherein also said device functions as a supplementary reservoir, said pressurizer device having a bleeder for bleeding air off to the atmosphere, and said piston having a hole with a pre-determined reduced diameter which enables the hydraulic fluid to flow into the chamber of said device above the piston.

* * * * *